United States Patent [19]

Hank

[11] 4,284,222

[45] Aug. 18, 1981

[54] PRESSING ROLLER FOR USE IN SHEET-ADVANCING ARRANGEMENTS

[75] Inventor: Dietrich Hank, Leipzig, German Democratic Rep.

[73] Assignee: VEB Polygraph Druckmaschinewerke Leipzig, Leipzig, German Democratic Rep.

[21] Appl. No.: 23,086

[22] Filed: Mar. 22, 1979

Related U.S. Application Data

[63] Continuation-in-part of Ser. No. 881,509, Feb. 27, 1978.

[30] Foreign Application Priority Data

Feb. 25, 1977 [DD] German Democratic Rep. ..... 1197548

[51] Int. Cl.[3] ..... B65H 17/22

[52] U.S. Cl. ..... 226/181; 226/194

[58] Field of Search ..... 226/181, 182, 183, 187, 226/190, 194, 174, 176, 177, 42; 200/83 R, 83 A, 83 Q; 251/12

[56] References Cited

U.S. PATENT DOCUMENTS 3,302,269 2/1967 Cooper et al. ..... 200/83 R 3,771,703 11/1973 St. Denis ..... 226/42

FOREIGN PATENT DOCUMENTS 1078978 4/1960 Fed. Rep. of Germany ..... 226/177

*Primary Examiner*—Leonard D. Christian

*Attorney, Agent, or Firm*—Michael J. Striker

[57] ABSTRACT

A pressing roller is used in a sheet-advancing arrangement to press the advancing sheet material against a driven roller to control the friction between the driven roller and the sheet material and thereby reduce, if not entirely eliminate, any slippage between the driven roller and the sheet material. Two levers pivotally mount the pressing roller on a housing which, in turn, is detachably mounted on a support, the housing being extremely flat and bounding a chamber which has an open end. A diaphragm deflectably spans and sealingly closes the open end of the chamber and urges the pressing roller and thus the sheet material against the driven roller with a force proportionate to the pressure prevailing in the chamber of the housing. Each of two springs is connected to one of the levers and to the housing and moves the pressing roller away from the driven roller when the pressure in the chamber drops below a predetermined value.

7 Claims, 2 Drawing Figures

PRESSING ROLLER FOR USE IN SHEET-ADVANCING ARRANGEMENTS

CROSS-REFERENCE TO RELATED APPLICATION

The present application is a continuation-in-part application of my copending patent application Ser. No. 881,509 filed Feb. 27, 1978, entitled "PNEUMATICALLY ACTUATED PRESSING ROLLER."

BACKGROUND OF THE INVENTION

The present invention relates to an arrangement for advancing sheet material in general, and more particularly to a pressing roller unit for use in such an arrangement.

It is well known that, in arrangements for advancing sheet material, such as webs, particularly paper webs or the like in the printing industry, one or a plurality of driven rollers contact the sheet material and advance the same in a predetermined path, for instance, through a plurality of printing stations or the like. The driven rollers may be arranged, for instance, at the location at which the web enters the arrangement, at a cooling arrangement or the like. Usually, a machine of the type here under consideration includes more than one of the driven rollers. Experience has shown that, because of the tension which prevails in the material of the paper web or the like, there exists the danger that slippage could occur between the driven roller and the paper web. To avoid this problem, it has been proposed in the past to provide one or a plurality of pressing rollers which press the paper web against the driven roller with a predetermined force to increase the friction between the driven roller and the paper web and thus reduce the likelihood of the occurrence of slippage between the driven roller and the paper web being advanced thereby.

So, for instance, a German Patent DT-PS No. 10 55 553 discloses an arrangement in which a pressing roller presses the paper web against a speed-controlling roller, the purpose of the provision of the pressing roller being to assure unproblematical entrainment of the paper web by the rotating speed-controlling roller. A particular disadvantage of this conventional arrangement is that the force with which the pressing roller is urged against the speed-controlling roller can be manually adjusted only within very narrow limits.

More recently, it has been proposed in a German published patent application DT-AS No. 19 19 762 published on Nov. 5, 1970 to construct the pressing roller as a rubber roller and to urge this pressing roller against the driven roller by means of pneumatically operated cylinder-and-piston units, the operation of which is controlled by a magnetically energized valve. However, even this arrangement utilizing the pneumatically operated cylinder-and-piston units still has some grave disadvantages. The relatively high friction between the piston and the cylinder of this unit distorts the loading results in such a manner that a precisely defined loading of the pressing roller is impossible. This is further aggravated by the fact that the loading of the bearings occurs in the transverse direction of the bearings of the piston rod, as a result of which there comes into existence an even additional friction. In addition thereto, this conventional arrangement requires a substantial amount of available space, which is of a particular disadvantage especially in an arrangement where several webs or loops of a single web are located in close proximity of each other.

SUMMARY OF THE INVENTION

Accordingly, it is a general object of the present invention to avoid the disadvantages of the prior art.

More particularly, it is an object of the present invention to develop a pressing roller for use in sheet or web advancing arrangements which is not possessed of the disadvantages of the prior-art pressing rollers.

A further object of the present invention is to develop a pressing roller unit which can be universally utilized, which permits the achievement of an especially fine variation of the pressing force, and which has a very small overall size, particularly height.

A concomitant object of the present invention is to propose a pressing roller unit which is simple in construction, inexpensive to manufacture, and very reliable in operation.

In pursuance of these objects and others which will become apparent hereafter, one feature of the present invention resides, in an arrangement for advancing sheet material, briefly stated, in a combination which comprises a support; two rollers; means for mounting said rollers on the support for rotation and for movement of at least one of the rollers into and out of an operating position in which the rollers confine the advancing sheet material between themselves; and means for controlling the friction between at least the other of the rollers and the advancing sheet material, including a housing mounted on the support and bounding a chamber having an open end, a diaphragm which deflectably spans and sealingly closes the open end of the chamber, means for transforming a deflection of the diaphragm into the movement of the one roller at least into the operating position, and means for varying the pressure in the chamber to thereby deflect the diaphragm and urge the one roller and thus the advancing sheet material confined between the rollers against the other roller with a force proportionate to the pressure in the chamber. Advantageously, a driving means is provided for rotating the other roller. A particularly advantageous embodiment of the present invention is obtained when the housing is extremely flat and is mounted on the support by detachably mounting means. Then, it is especially advantageous when the mounting means for mounting the one roller includes at least one, but preferably two, levers which are pivoted on the housing, there being further provided means for moving the one roller out of the operating position which includes at least one spring, but preferably two springs, connected to the housing and to the lever or levers. It is also currently preferred when the transforming means is constructed as a diaphragm disk which is interposed between the diaphragm and the levers.

The pressing roller unit of the present invention has the advantage that, instead of the frictional forces which are encountered in the conventional pneumatically operated cylinder-and-piston units, deformation forces are present in the arrangement of the present invention which are faultlessly reproducible even after extended periods of use of the arrangement of the present invention; in other words, for the same pressure in the chamber of the housing, the deformation of the diaphragm and the force with which it acts on the pressing roller, will always be the same during the useful lifespan of the diaphragm. Another advantage is that the dimensions, particularly the height, of the pressing roller unit can be made extremely small so that the pressing roller units are also usable under circumstances where only a minimum amount of space is available or where space is at a premium. In addition thereto, these units need not be lubricated nor maintained in any other manner, and they are very economically manufacturable, especially in view of the fact that no especially carefully produced sliding surfaces are required, unlike in the pneumatic cylinder-and-piston units of the prior art.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DISCUSSION OF THE PREFERRED EMBODIMENTS

Figure 1:
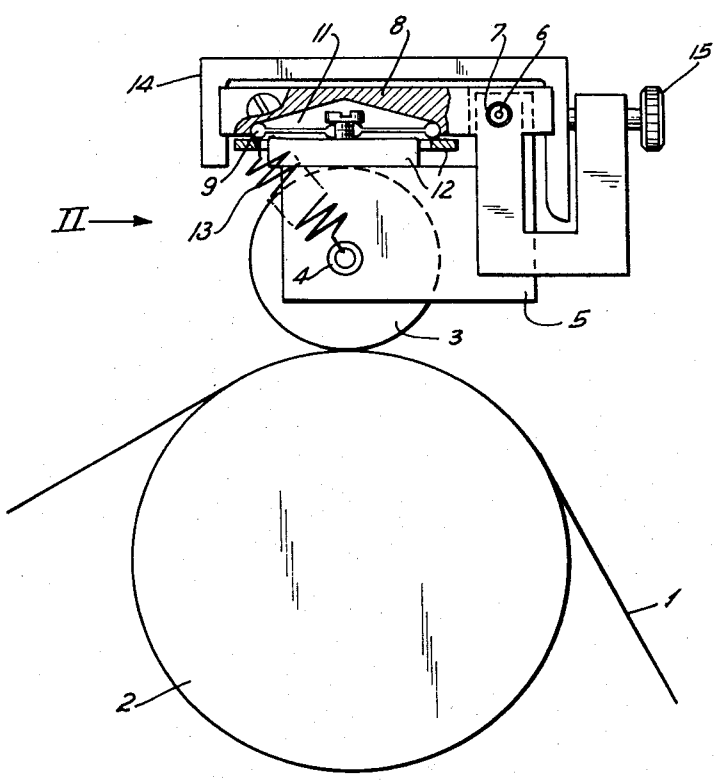
FIG. 1 is a side elevational view of a pressing roller of the present invention.

Referring now to the drawing in detail, and first to FIG. 1 thereof, it may be seen that the reference numeral 1 designates a web which surrounds, to a greater or lesser extent, a driven roller 2, which may be a so-called pulling roller at the entrance of a rotary folding device, a cooling roller within a cooling device, or the like. The web 1 is pressed against the circumferential surface of the driven roller 2 by means of a pressing roller 3. Usually, it will be preferable to distribute a plurality of the pressing rollers 3 over the width of the web 1. The following discussion will concern a device which supports a pressing roller 3 of this type, which device will be referred to in its entirety as a pressing roller unit.

The pressing roller unit includes a shaft 4, and the pressing roller 3 is supported on the shaft 4 for unimpeded rotation. The shaft 4 is supported in levers 5, 5' which are pivotally supported on a housing 8 by means of a pivot 6 having an axis 7.

Figure 2:
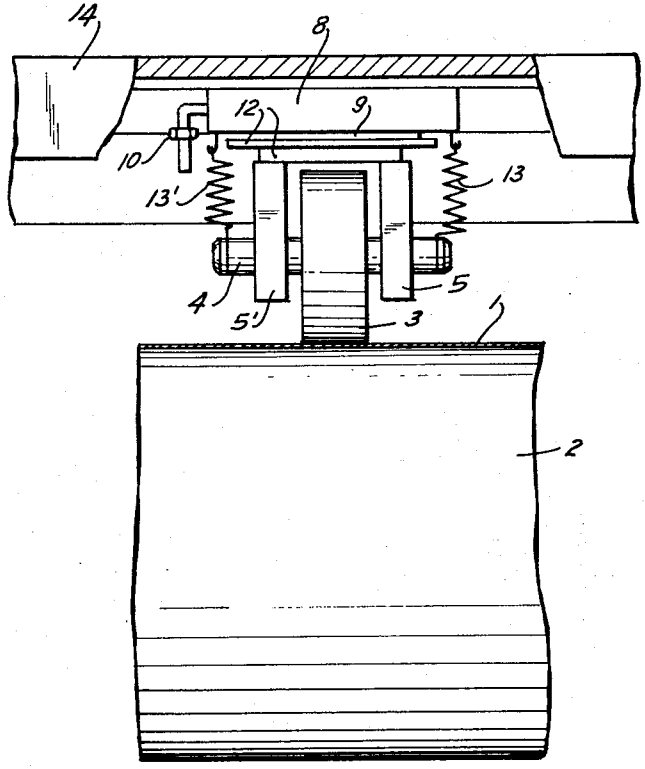
FIG. 2 is a view taken in the direction of the arrow II of FIG. 1.

The housing 8 is made extremely flat and a diaphragm 9, preferably of rubber, is so arranged in the housing 8 that it closes an internal chamber 11 bounded by the housing 8 in the downward direction as illustrated in the drawing. A pressurized air conduit 10 communicates with the chamber 11 at one of its ends, and with a non-illustrated conventional pressurized air source at its other end. The diaphragm 9 extends across the open lower end of the chamber 11 and is deflectable in dependence on the pressure prevailing in the chamber 11. A diaphragm disk 12 is interposed between the diaphragm 9 and the two levers 5 and 5', the diaphragm disk 12 exerting a force on the levers 5, 5' when the pressurized air is admitted into the chamber 11 and thus acts on the diaphragm 9 from one side. Tension springs 13, 13' are arranged between and connected to the housing 8 and to the respective ones of the levers 5, 5', as particularly clearly seen in FIG. 2.

The housing 8 is supported on a transverse beam 14 of the machine in which the pressing roller unit is used, being detachably connected to the transverse beam 14 by means of a screw 15 having a knurled head. As a result of this easily mountable and dismountable connection, the pressing roller unit can be arranged at any location, or a plurality of such pressing roller units can be distributed, over the entire width of the web 1. Also, the pressing roller units of the present invention can be easily positionally readjusted.

Having so discussed the construction of the arrangement of the present invention, the operation thereof will be now briefly discussed. First of all, the pressing roller unit or a plurality of such units is located at the appropriate location or locations. When at these locations, the units, and more particularly the pressing rollers 3 thereof, will be juxtaposed with that major surface of the web 1 which faces away from the driven roller 2. Initially, that is, when no pressurized air is admitted through the conduit 10 into the chamber 11, the springs 13, 13' will retract the levers 5, 5' and thus the pressing roller 3 at least slightly from the abovementioned opposite major surface so that the leading end of the web 1 can be easily introduced into the advancing arrangement and particularly into the gap between the pressing roller 3 and the driven roller 2. Now, pressurized air is introduced into the chamber 11 via the conduit 10, the pressure of the pressurized air in the chamber 11 deflecting the diaphragm 9 downwardly, thus pushing the diaphragm disk 12 also in the downward direction and thus pivoting the levers 5, 5', in the counterclockwise direction as seen in FIG. 1, about the axis 7 of the pivot 6, against the force of the springs 13, 13', once the pressure in the chamber 11 is sufficient to overcome the force of the springs 13, 13'. During this pivoting, the pressing roller 3 contacts the above-mentioned opposite major surface of the web 1 and, depending on the magnitude of the pressure prevailing in the chamber 11, the pressing roller 3 presses the web 1 with a predetermined force against the driven roller 2. Thus, by finely controlling the pressure of the pressurized air in the chamber 1, it is possible to extremely finely adjust the force with which the pressing roller 3 presses the web 1 against the driven roller 2. It will be appreciated that the friction between the driven roller 2 and the web 1 will increase with the increasing force with which the roller 3 acts on the web 1. Thus, the pressing force of the pressing roller 3 can be controlled within a wide range but in a very fine fashion in dependence on various operating parameters, such as, for instance, the tension of the web 1.

It will be understood that each of the elements described above, or two or more together, may also find a useful application in other types of constructions differing from the types described above.

While the invention has been illustrated and described as embodied in a pressing roller for use in an arrangement for advancing paper webs, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In an arrangement for advancing sheet material, a combination comprising a support; two rollers; means for mounting said rollers on said support for rotation and for movement of at least one of said rollers into and out of an operating position in which said rollers confine the advancing sheet material between themselves; means for biasing said one roller out of said operating position; means for controlling the friction between at least the other of said rollers and the advancing sheet material, including a housing mounted on said support and bounding a chamber having an open end, a diaphragm deflectably spanning and sealingly closing said open end of said chamber; means for transforming a deflection of said diaphragm into the movement of said one roller into said operating position; and means for varying the pressure in said chamber to thereby deflect said diaphragm and urge said one roller against said biasing means and thus the advancing sheet material confined between said rollers against said other roller with a force proportionate to the pressure in said chamber.

2. A combination as defined in claim 1; and further comprising driving means for rotating said other roller.

3. A combination as defined in claim 2, wherein said housing is of a flat configuration; and further comprising means for detachably mounting said housing on said support.

4. A combination as defined in claim 1, wherein said mounting means for mounting said one roller includes at least one lever, and at least one pivot which pivotally mounts said lever on said housing.

5. A combination as defined in claim 4; and further comprising means for moving said one roller out of said operating position, including at least one spring connected to said housing and to said lever.

6. A combination as defined in claim 5, wherein said lever and said spring are mounted on said pivot at one axial end of said one roller; wherein said mounting means for mounting said one roller further includes another lever mounted on said housing at the other axial end of said one roller similarly to said lever; and wherein said means for moving said one roller out of said operating position further includes an additional spring connected to said housing and to said additional lever.

7. A combination as defined in claim 6, wherein said transforming means includes a diaphragm disk interposed between said diaphragm and said levers.

* * * * *